US005208611A

United States Patent [19]

Kappel et al.

[11] Patent Number: 5,208,611

[45] Date of Patent: May 4, 1993

[54] ARRANGEMENT FOR HEATING THE INK IN THE WRITE HEAD OF AN INK-JET PRINTER

[75] Inventors: Andreas Kappel; Rudolf Probst, both of Munich, Fed. Rep. of Germany

[73] Assignee: Mannesmann Aktiengesellschaft, Düsseldorf, Fed. Rep. of Germany

[21] Appl. No.: 715,794

[22] Filed: Jun. 14, 1991

[30] Foreign Application Priority Data

Dec. 14, 1988 [EP] European Pat. Off. ..... 88120858.1

[51] Int. Cl.[5] ..... B41J 2/05

[52] U.S. Cl. ..... 346/140 R

[58] Field of Search ..... 346/140 R, 75, 76 PH; 219/485, 490

[56] References Cited

U.S. PATENT DOCUMENTS

| | | | |
|---|---|---|---|
| 4,567,353 | 1/1986 | Aiba | 219/501 |
| 4,612,554 | 9/1986 | Poleshuk | 346/140 R |
| 4,719,472 | 1/1988 | Arakawa | 346/140 R |

FOREIGN PATENT DOCUMENTS

| | | | |
|---|---|---|---|
| 2659398 | 7/1978 | Fed. Rep. of Germany . | |
| 62156971 | 12/1979 | Japan . | |
| 0002370 | 1/1985 | Japan | 346/140 R |
| 61206657 | 12/1985 | Japan . | |

*Primary Examiner*—Benjamin R. Fuller
*Assistant Examiner*—N. Le
*Attorney, Agent, or Firm*—Horst M. Kasper

[57] ABSTRACT

A heating device of a write head based on layer technology for an ink jet printer is furnished as a heating resistor (15) in the form of a heating conduit meander directly from an electrically conductive thin film, disposed in the empty spaces on a substrate, and deposited on the base oxide for furnishing the thermal converter and the conductor paths (5, 6). The empty spaces are thereby created by a spacing and a group-like combination and a gathering of the conductor paths (5, 6), wherein part sections of the heating resistors (15) are embedded in the empty spaces. The heating resistor (15) is part of a resistance measurement bridge and is employed simultaneously as a heat source and as a temperature sensor based on processing and evaluation of its electrical resistance values at different points in time.

36 Claims, 7 Drawing Sheets

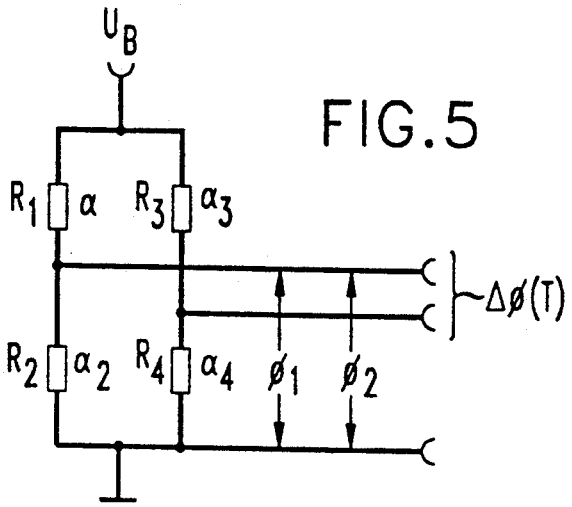
FIG.5
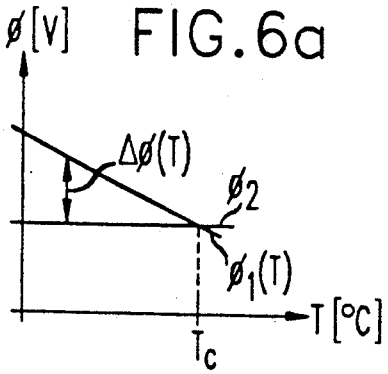
FIG.6a
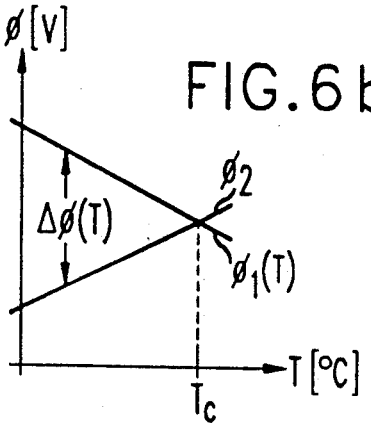
FIG.6b
FIG.7
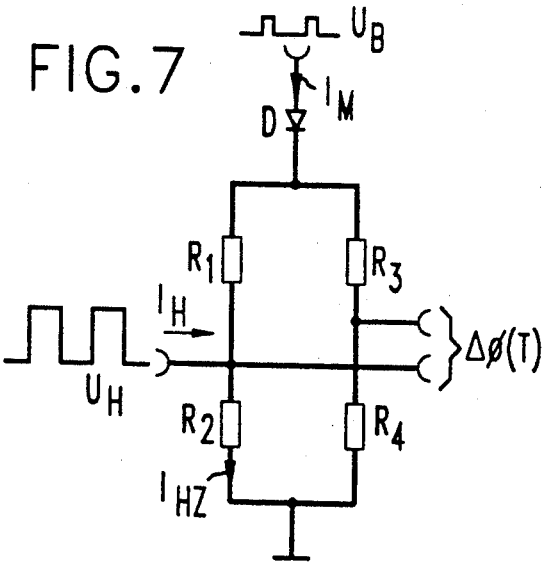
FIG.8
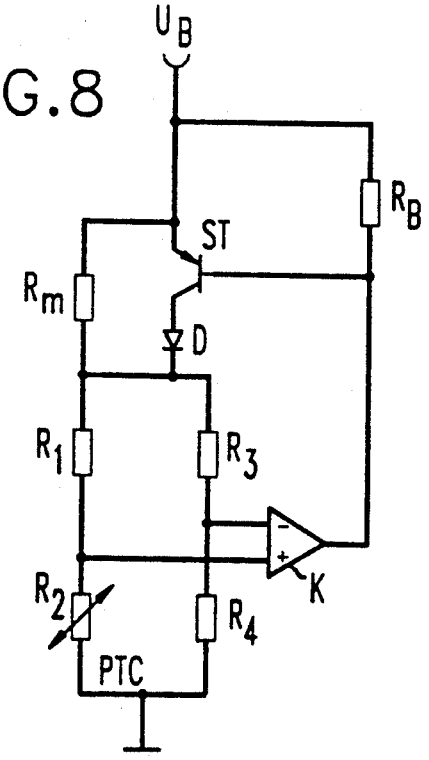

ARRANGEMENT FOR HEATING THE INK IN THE WRITE HEAD OF AN INK-JET PRINTER

CROSS-REFERENCE TO RELATED APPLICATIONS

This application is a continuation-in-part application of another international application filed under the Patent Cooperation Treaty Dec. 4, 1989, bearing Application No. PCT/EP89/01480, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The invention relates to an arrangement for the heating of the ink in the laminated write head of an ink-jet printer, which is constructed based on the layering technique.

2. Brief Description of the Background of the Invention Including Prior Art

Individual ink droplets are conventionally ejected from the nozzles of a write head, under the control exercised by an electronic control system where the write head is part of an ink-jet printer for the production of characters on a recording substrate. Characters and/or graphic patterns are generated on a recording substrate as grids within a character matrix by tuning the ejection of individual droplets and the relative motion between the recording substrate and the print head. The operational safety and the quality of the recording depend to a large extent on the uniformity of the droplet ejection, i.e. the individual droplets ejected based on a control pulse have to exhibit a defined size and have to leave the nozzle of the write head in each case with the same speed. The boundary conditions for formation of a uniform droplet ejection are multifaceted. For example, the ink drop formation or the ink-jet formation, respectively, the ink droplet mass and the flight motion velocity of the ink drops in such printers depend to a large extent on the viscosity of the ink. Since the viscosity of the ink depends on temperature, the ink has to be sufficiently well controlled with respect to temperature by way of a heating device, in order to assure, on the one hand, that an ink ejection process is at all possible in case of different temperatures and, on the other hand, that this ink ejection process is performed as defined and as stable as possible. For this purpose, it is already known to maintain the temperature of the ink in an ink write head at a constant value. For a write head, where individual ink channels are furnished and where the individual ink channels end at the ejection nozzles of a nozzle plate, it is known from the German Patent Application Laid-Open DE-OS 2,659,398, to furnish a heating element in the nozzle plate. Furthermore, it is known for such write heads to dispose an induction coil in the area of the nozzle plate and to heat the nozzle plate by eddy currents and remagnetization losses, of. German Patent Application Laid-Open DE-OS 3,500,820.

Ejection of individual ink droplets occurs in high-resolution ink-jet printers according to the so-call bubble-jet principle, and the write head is formed and constructed in such printers according to the thin-layer technology, by generating an ink-vapor bubble in the respective ink channel in the region of individually controllable electrothermal energy converters disposed in the ink channels. The generated vapor bubble ejects a certain predetermined ink volume as a droplet out of the ink channel.

The temperature dependence of the viscosity of the ink is a very important factor for write heads of this kind. Consequently, it is also known for write heads of the recited kind to improve the ejection conditions by a preheating of the ink. This can be performed by employing additional, external heating elements acting on the ink from outside a channel, such as described for example in the German Patent Applications Laid Open DE-OS 2,943,164 or DE-OS 3,545,689. Frequently, resistors with a positive temperature coefficient are employed as heating elements. Thus, the temperature of the ink in the write head can be brought to and maintained at a certain elevated predetermined temperature value in connection with a control circuit and with a temperature sensor element, where the temperature sensor element can frequently be a negative temperature coefficient resistor. However, relatively long heating times result in particular in connection with write heads with electrothermal converters. The reason for this is that steps and means for cooling have to be provided for write heads with electrothermal converters because of the accompanying heating of the ink occurring during the ongoing printing operation. For this purpose, the print head is usually disposed at a cooling surface, for example, on an aluminum plate. If after longer intervals between printing operations, or in case of the switching-on of the ink-jet printer, the ink has to be heated, then it is always necessary that the cooling surface be heated up at the same time. Based on this, there result relative long heat-up times. In addition, the construction and production-technological expenditures associated therewith are not negligible, since in each case additional individual elements have to be kept ready, mounted, and electrically connected.

It is already known from the German Patent Application Laid-Open DE-OS 2,943,164 to dispose a heating coil in the interior of the ink volume space. In addition to the construction expenditures, there result however, also problems based on chemical processes occurring between the coil material and the ink liquid.

In addition, it is conceivable to dispose an ink heater and temperature sensor at the bubble-jet write head in an additional plane of the thin film substrate. However, such a structure is associated with several production-technological and economical disadvantages affecting and related to the reliability, yield, and processing times of such print heads, since additional process steps are required for this purpose, such as deposition, lacquer deposition, illumination, development, etching, photoresistant layer degradation, covering, etc. In addition, a certain failure probability exists based on electric short circuits between the two large-faced conductor arrangements for the heating element, the sensor and for the bubble-jet structure, furnished by an aluminum conductor structure, where the conductor arrangements are separated only by a thin oxide, typically of a thickness of about 2 micrometers.

SUMMARY OF THE INVENTION

1. Purpose of the Invention

It is an object of the present invention to furnish a system for preheating or for heating, respectively, the ink for a print head in ink-jet printers, where short heat-up times and low power input of the arrangement assures a good control behavior while maintaining low production costs.

It is yet a further object of the present invention to provide a structure which results in a define and reliable ejection of ink-jet bubbles.

These and other objects and advantages of the present invention will become evident from the description which follows.

2. Brief Description of the Invention

The present invention provides for a device for the heating of the ink in a write head constructed based on layer technology for an ink-jet printer. A plurality of electrothermal converter elements 4 are disposed in ink channels and are controlled via individual current feed lines provided as conductor paths 5, 6. The electrothermal converter elements 4 and the conductor paths 5, 6 are generated in a single metallization plane on a substrate 2. In each case a number of conductor paths 5, 6 are combined to groups, which groups in turn are placed at a distance defined by intermediate spaces. Part sections of a large-face heating resistor 15 are entered into these intermediate spaces in the first metallization plane. The part sections of the large-face heating resistor are electrically connected amongst each other. The part sections of the heating resistor 15 and the conductor paths 5, 6 are lead at an edge region of the write head and are contacted at the edge region. The electrothermal converter elements 4, the conductor paths 5, 6 and the heating resistor 15 are jointly covered with an isolator layer 7.

The individual part sections of the large face heating resistor 15 can be structured in a meander shape. The heating resistor 15 can be made of a material with a high temperature dependence of the electrical resistance. The heating resistor 15 can serve as a heat source and simultaneously as a temperature sensor.

The heating resistor 15 can be disposed and connected in a branch of a measurement bridge of a bridge circuit for heating and for temperature measurement. A temperature signal $\Delta\phi(T)$ can be picked up at the diagonal of the bridge. The remaining bridge resistors can be integrated into the first metallization plane. At least one of the bridge resistors can serve for heating. At least one of the bridge resistors can serve for temperature measurement.

The measurement bridge can be passed through by the total heating current $I_H$. The temperature signal of at least one branch of the bridge can be processed and evaluated. The measurement bridge can be passed through by a measurement current $I_M$ which has a smaller value than the value of the heating current $I_H$. Only the heating resistor 15 can be fed with current for heating.

A separate thin-film temperature sensor can be employed for measuring the heating temperature of the heating resistor 15. This thin-film temperature sensor can be integrated into the first metallization plane. A separate, discrete temperature sensor can be employed for measuring the heating temperature of the heating resistor 15.

An analog comparator K can serve for evaluation of the temperature signal $\phi$, (T) generated by the measurement bridge. The output of the comparator K can control the voltage supply $U_B$ for the measurement bridge via an electronic switch ST. Two-point automatic control circuits with an external system clock-cycle S can be employed for an automatic control of the temperature. The two-point automatic control circuits can apply during a half period of the system clock-cycle S the measurement current $I_M$ to the measurement bridge. The temperature signal $\Delta\phi$ (T), picked up at the bridge diagonal, can be fed to a comparator IC1 for evaluation. The output signal of the comparator IC1 can be entered and registered into a memory storage member IC2, IC3. During the next half cycle of the system clock-cycle S, the heating resistor 15 can either be fed with current or not fed with current depending on the entry into the memory storage member C2, IC3. The memory storage member IC2, IC3 can be provided as a bistable multivibrator.

An arrangement for generation of heat in the ink can be realized in a simple way by generation of the heating resistor formed as a heating meander immediately from one of the two electrically conducting thin films, deposited for heat transducing thermal converters and conductor paths and disposed on the base oxide in empty spaces present in the substrate. No additional process step is necessary in this context since the layout of the heating meander can be incorporated into the corresponding illumination and etching masks for the thermal converters and for the conductor paths. The obligatory covering of the thermal converters and of the conductor paths with an insulator covers simultaneously also the heating meander.

In addition, such a structure is associated with the advantage that, based on the small thickness of the base oxide, which is typically 3 micrometers silicon dioxide, there results a very good thermal coupling of the heating meander to the substrate exhibiting good thermal conductivity which substrate is a silicon disk in typical cases. High heating-power throughputs with low heating times can be achieved without a danger of a thermal overloading of the heating meander. Since the heating meander and the ink are in close spatial contact over a large surface area in case of an arrangement according to the present invention, a small heating capacity for setting the desired temperature will be sufficient as compared to a situation involving an external heating element.

In addition, the large heat conductivity of the silicon substrate results in a substantially homogeneous heat distribution within the total write head, even if the heating meander cannot be arranged distributed uniformly over the write head based on the empty spaces present on the write head.

It is particularly advantageous for the heating meanders to employ material with high positive temperture coefficients of resistivity, for example aluminum metal, because this heating meander can then be used simultaneously as a heating source and as a temperature sensor based on evaluation of the electrical resistor property of the heating meander by an appropriate sensor circuit. This results in a very good response and control function behavior since no dead times between temperature sensor and heating element occur. In particular no thermal time delay will exist between heating element and sensing element.

A temperature signal can be obtained in an easy way by incorporating the heating resistor into a resistance measurement bridge, where all tolerance-critical device components of the resistance bridge are integrated into a first metallizing plane. The temperature signal is used as an input signal delivered to the automatic control circuit. Employing two bridge branches for temperature measurement allows in addition to double the temperature use signal or to double the signal strength of the temperature signal delivered to the automatic control circuit.

Moreover, there exists the possibility of a balancing of the bridge formed on the thin-film substrate during use, for example, by laser trimming. Based on a balancing of the measurement bridge and/or heating bridge, disposed on the thin-film substrate, with the automatically controlled temperature, no pairing is required between the heating sensor element and the automatic heating current providing electronics. This configuration is associated with the advantage that the write heads and automatic heating electronics can be combined as individual elements as desired, for example an exchange of a defective write head in a printer will not require a new functional balancing to obtain the desired automatic control current for obtaining a defined temperature at the heating element.

Upon use of a clock-cycled automatic control electronic system, there occur only small power losses in the switching transistor based on the cyclical operation. Only a very small wave amplitude for the time dependence of the temperature occurs in case of a sufficiently high clock cycle frequency of the clock-cycled automatic control system. Since the heating resistor will only be fed with heating current and used for heating purposes and since the total resistance bridge is not fed with heating current, it is possible to furnish the remaining bridge resistances on the thin-film substrate within a very small space, for example, by employing a structure incorporating a material exhibiting a high ohmic resistance.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 5 is a view of a schematic circuit diagram illustrating a resistor arrangement formed as a bridge circuit for furnishing heating and for temperature measurement;

FIG. 6*a* is a view of a functional diagram illustrating the course of the temperature signal values versus temperature upon employment of one bridge circuit;

FIG. 6*b* is a view of a functional diagram illustrating the course of the temperature signal values versus temperature upon employment of two bridge circuits;

FIG. 7 is a view of a schematic circuit diagram illustrating a measurement bridge and a heating bridge, where only the heating resistor is fed with heating current;

FIG. 8 is a view of a circuit diagram of an analog comparator circuit and of an automatic proportional controller with a floating measurement bridge;

DESCRIPTION OF INVENTION AND PREFERRED EMBODIMENT

Figure 1:
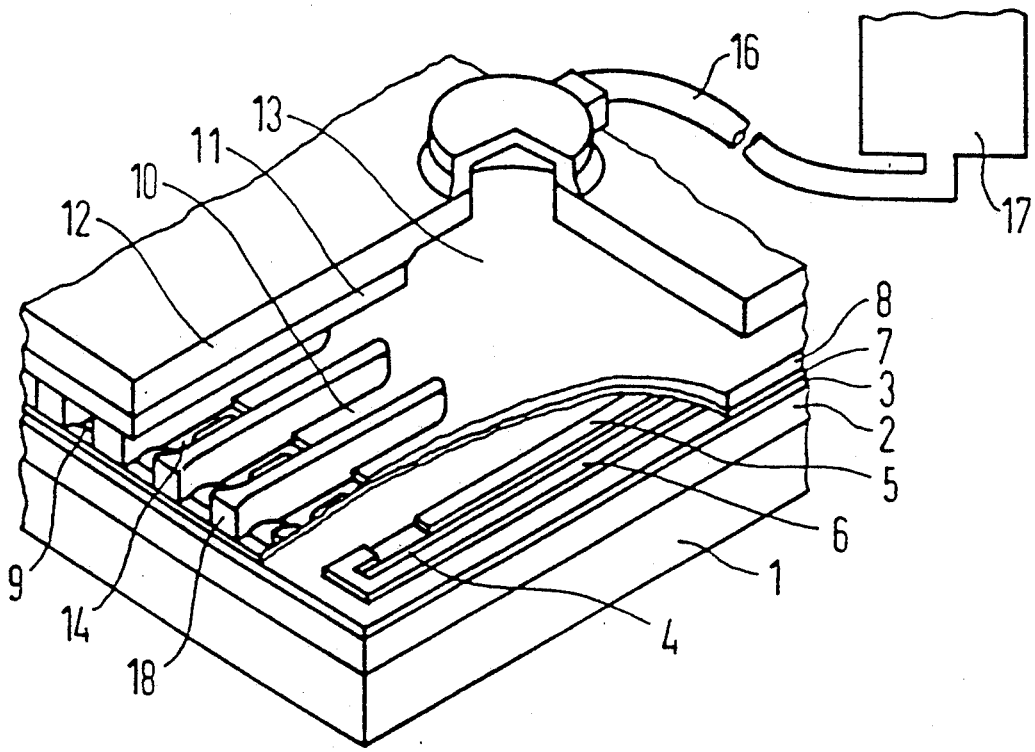
FIG. 1 is a view of a schematic perspective representation of part of an ink-jet write head, constructed by thin-layer technology, but without heating arrangement of the invention.

In accordance with the present invention there is provided an ink-jet printer, illustrated in part in FIG. 1 employing a bubble-jet system and operating according to the thermal converter principle while using the thermoelectric effect. The method for obtaining a pressure build-up in the ink disposed in a channel is based on the generation of small microbubbles in the ink. An electrothermal converter element, formed as a thin-film resistor with lateral dimensions of typically 150 micrometers×30 mircrometers and a thickness of about 200 nanometers, operates as an actor, heater, and bubble inducer. This converter element is disposed directly in one ink channel at a certain distance relative to the exit nozzle. The converter element is charged during a short time span of, for example, 7 microseconds with a power of 6 watts for generating a pressure pulse. After about 5 microseconds the heating layer of the converter element reaches a temperature of about 250° C. and the evaporation phase starts for the adjoining ink. The penetration depth of the temperature into the ink column, disposed above the converter element, amounts thereby to only 10 micrometers. This transient heating is of essential importance for the functioning of the bubble jet, since highest possible excess temperatures in the neighborhood of the critical point of the ink have to be reached in a thin liquid layer in order to generate a rapid pressure rise and thus a stable evaporation process. The evaporation is associated with a pressure rise in the immediate neighborhood above the heating layer of about 23 atm and with a heating of the heating layer to about 360° C. The ink is accelerated in the capillary channel upon the expansion of the thereby generated vapor bubble and thus the ink is ejected as an ink jet through a nozzle.

The perspective illustration of part of the invention apparatus according to FIG. 1 shows the structural layout and the essential components of such an ink-jet write head. In detail, these include a base plate 1, usually manufactured from aluminum. A substrate 2, serving as a carrier substrate, is placed on the base plate 1, for example by way of an adhesive attachment. A silicon wafer serves in this case as the substrate 2. An about 3 micrometers thick first covering layer 3, made of silicon dioxide, is deposited on this substrate 2 by way of a chemical process, such as a chemical vapor deposition CVD, for forming a heat barrier and an insulation layer. The first covering layer can be from about 0.5 to 10 micrometers thick and is preferably from about 1 to 5 micrometers thick, such as for example 3 mm thick. This silicon dioxide layer can be alternatively generated by thermal oxidation of the silicon wafer. A resistance layer 4, operating as an electrothermal converter element and heat transducer, and aluminum layers serving as conductor paths 5, 6 for these thermal converters 4, are dusted or precipitated onto the thus preprocessed wafer in one single process step. After a photographic structure formation of the conductor paths 5, 6 and of the thermal converter 4, there is applied a further chemical vapor deposition process, furnishing a second covering layer 7 made of silicon dioxide for insulation and for mechanically stabilizing the thermal converter 4. The second covering layer 7 can be from about 0.5 to 10 micrometers thick and is preferably from about 1 to 4 micrometers thick such as for example 2 micrometers thick. In addition, a tantalum layer 14 is applied as cavitation protection above the thermal converters 4. The tantalum layer can be from about 0.1 to 2 micrometers thick and is preferably 0.3 to 1 micrometer thick such as for example 0.6 micrometers thick. A polyamide layer 8 is additionally projected as corrosion protection onto the second covering layer 7 and covers the tantalum layer 14 at its edges and forms a lower wall both for an ink chamber 13 as well as for the ink channels 10. The polyamide layer 8 can have a thickness of from about 0.5 to 10 micrometers and is preferably from about 1 to 4 micrometers thick such as for example 2 micrometers thick. The ink channels 10, starting from the ink chamber 13, join into an exit opening 9 at a so-called nozzle plate. Said ink channels 10 are isolated from each other by channel separating walls 18. In each case, an ink channel 10 is coordinated to a respective exit opening 9 and to a respective thermal converter 4. The structure is closed in upward direction by an adhesive layer 11 and a cover plate 12, following to the adhesive layer 11, such that a sequence of ink channels and the ink chamber 13, common to all ink channels 10, are formed between the polyamide layer 8 and the adhesive layer 11. The ink channels and the ink chamber 13 are connected via an ink supply line 16 to an ink storage tank 17.

Figure 2:
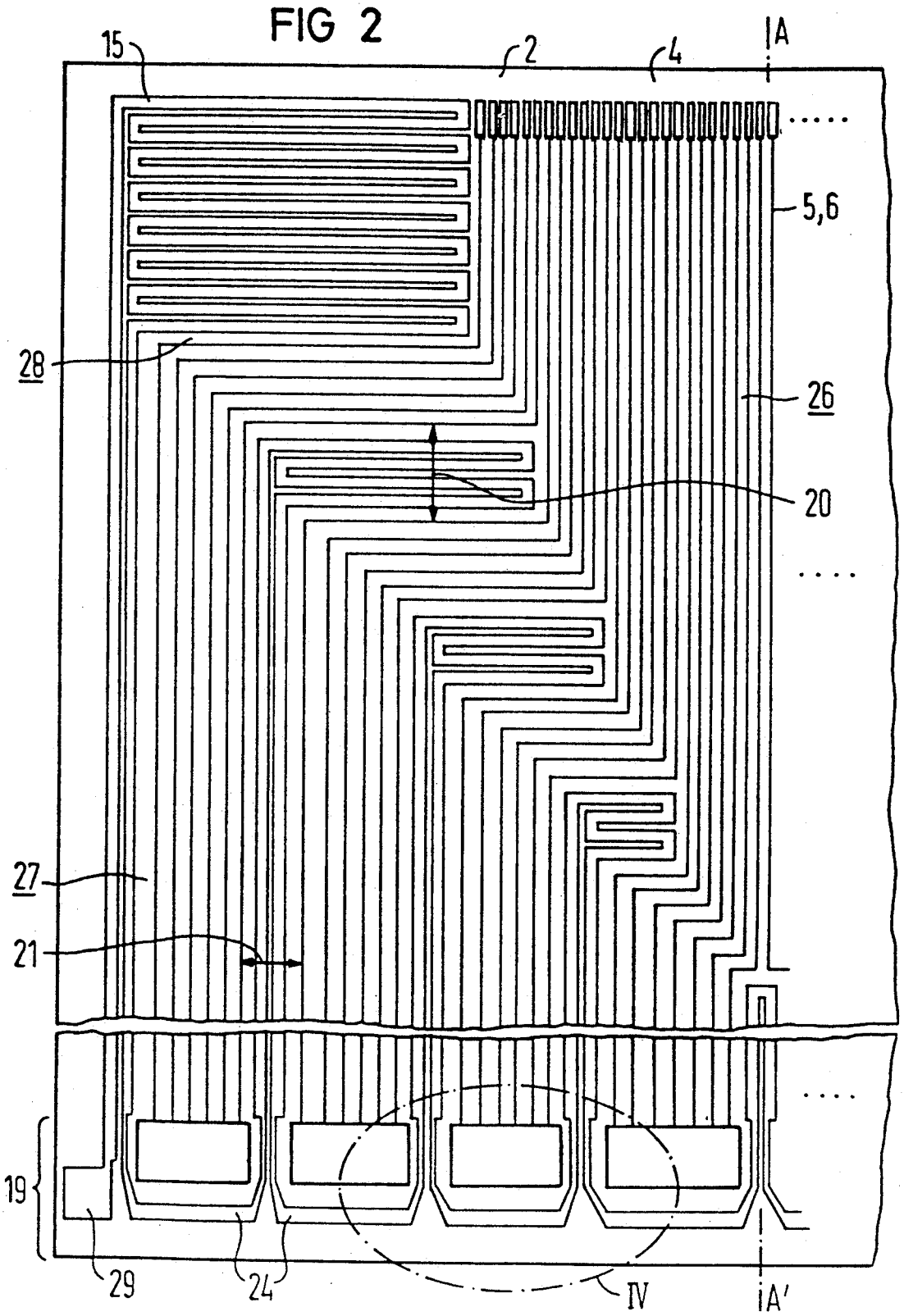
FIG. 2 is a sectional view of a conductor path layout of a write head according to FIG. 1 including a heating resistor integrated in a first metallization plane.

According to FIG. 2 of the invention, a heating device for the heating of the ink is furnished as a heating resistor 15, integrated into the first metallizing plane of the ink-jet write head. The heating resistor 15 is generated directly from one of two electrically conductive thin films, deposited on the base oxide, and in particular in empty spaces present on the thin-film substrate. The electrically conductive thin films are furnished for forming the thermal converters 4 and the conductor paths 5, 6.

The thermal converter 4 and the corresponding feed lines are disposed symmetrically relative to the axis AA' (FIG. 2) on the thin-film substrate 2, as illustrated in FIG. 2. Consequently, it is sufficient for the following considerations to represent and illustrate only a part section, i.e. the left half, of the conductor-path layout for such a write head. This print head exhibits fifty thermal converters 4, which are electrically supplied via a respective forward current and return current line for each thermal converter 4. These electrical feed lines form a plane and lead as conductor paths 5, 6 from the thermal converters 4, disposed in an edge-proximity region of the write head, to a terminal connector field 19, disposed on the opposite of said plane. The conductor paths are contacted with individual conductors of a connection cable, not illustrated in the drawing. Since, on the one hand, a sufficient space has to be available for this contact formation and since, on the other hand, the thermal converters 4 are relatively small and disposed closely adjacent for furnishing a highest possible resolution capability, the conductor paths 5, 6 are spread out on the thin-film substrate 2. Consequently, the conductor paths 5, 6 are subdivided, starting from the thermal converters 4, into conductor paths of narrow subdivision 26, and in the region of the connector terminal field 19, into conductor paths of wide subdivision 27. A transition structure 28 (FIG. 2) connects the conductor paths of narrow subdivision 26 to the conductor paths of wide subdivision 27. A feedline resistance as uniform as possible and as low as possible for all thermal converters 4 can be achieved by a suitable dimensioning of this transition structure 28, in particular of the conductor path width and the slot width, i.e. the distance between two neighboring conductor paths depending on the conductor path widths and the slot widths in the two other regions of subdivisions 26, 27. This is important in particular for a stable operation of the ink-jet printer, since the thermal energy power, released in the various thermal converters 4 of the write head for each pressure print pulse, has to be the same within very narrow limits. Otherwise, there exists the danger of the destruction of individual thermal converters 4 based on overheating.

Figure 3:
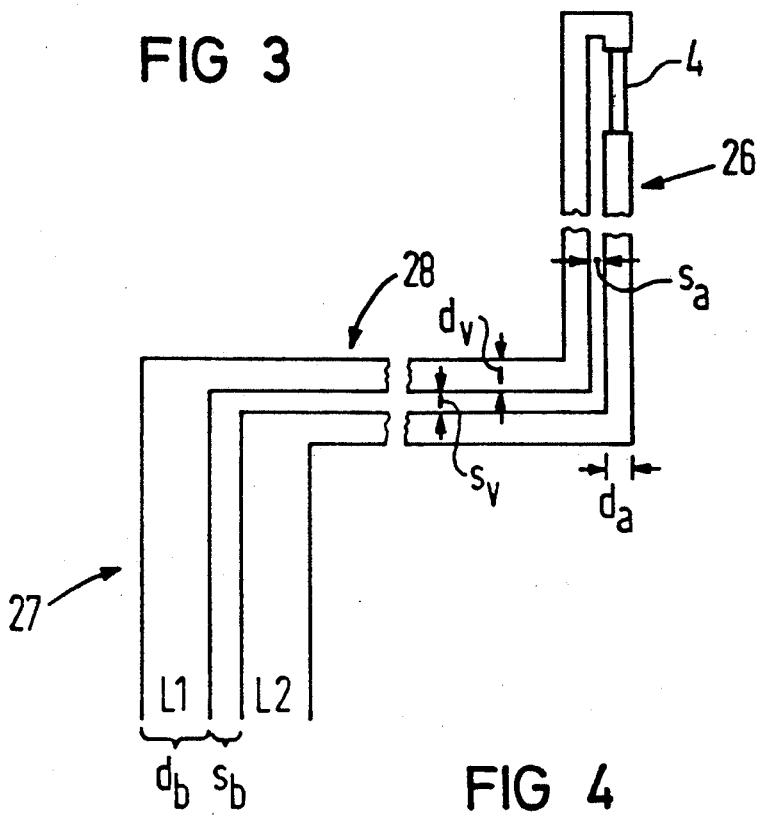
FIG. 3 illustrates a view of an enlarged section of the conductor path layout of FIG. 2.

The conductor width in the transition structure 28 can be dimensioned according to the following calculations based on the above-recited structural values of the two conductor-path regions of the narrow and the wide subdivisions 26, 27 to be connected, and based on the designations, introduced in FIG. 3, for two neighboring conductor paths L1, L2, namely the conductor-path widths $d_a$, $d_b$ and the slot widths $s_a$, $s_b$, as well as from the slot width $s_v$ in the transition structure 28:

$$d_v = -s_v/2 + \sqrt{s_v^2/4 + c} \text{ with}$$

$$c = d_b \cdot d_a \cdot (d_b + s_b - d_a - s_a)/(d_b - d_a).$$

In order to decrease the number of the individual conductors of the connection cable, the conductor paths are combined into a total of eight groups in the connector terminal field 19. In each case, seven thermal converters 4 with their fourteen conductor paths, i.e. in each case a feed and a return line for each thermal converter 4, are combined in the two groups disposed immediately next to the symmetry line AA' (FIG. 2), while the remaining six groups in each case combine six thermal converters with their twelve conductor paths. Based on reasons of clarity and straight forward consideration, however, FIG. 1 illustrates only one single connector line per thermal converter 4. The precise wiring of the in total one hundred conductor paths for the fifty thermal converters 4 will be illustrated in more detail below with reference to FIG. 4.

By forming such a combination of individual conductor paths in groups and based on the subdivision into three regions with different partitions, empty spaces are generated between the conductor paths of two neighboring groups, where the widths of the empty spaces correspond to the group distances 20, 21 illustrated in FIG. 2, and where the empty spaces are employed for placement of a respective ink heater. The ink heater is introduced in this case by forming a resistance heating meander in these empty spaces. The two feed lines of the heating resistor 15 run in the edge region of the substrate surface to the connector terminal field 19 and end at connector flags 29, where only one of these connector flags 29 is illustrated in FIG. 2. According to the number of the empty spaces, generated by the spreading of the conductor paths, the thermal resistor 15 is subdivided into several part sections, which are connected in the connector terminal field 19 with a contact bridge 24. In each case, the end of a part section is connected to the starting point of the next following part section according to FIG. 4, such that there results overall a series connection of the part sections and the thermal resistor 15 can be subjected to a heating voltage and/or a heating current at the connector flags 29.

Figure 4:
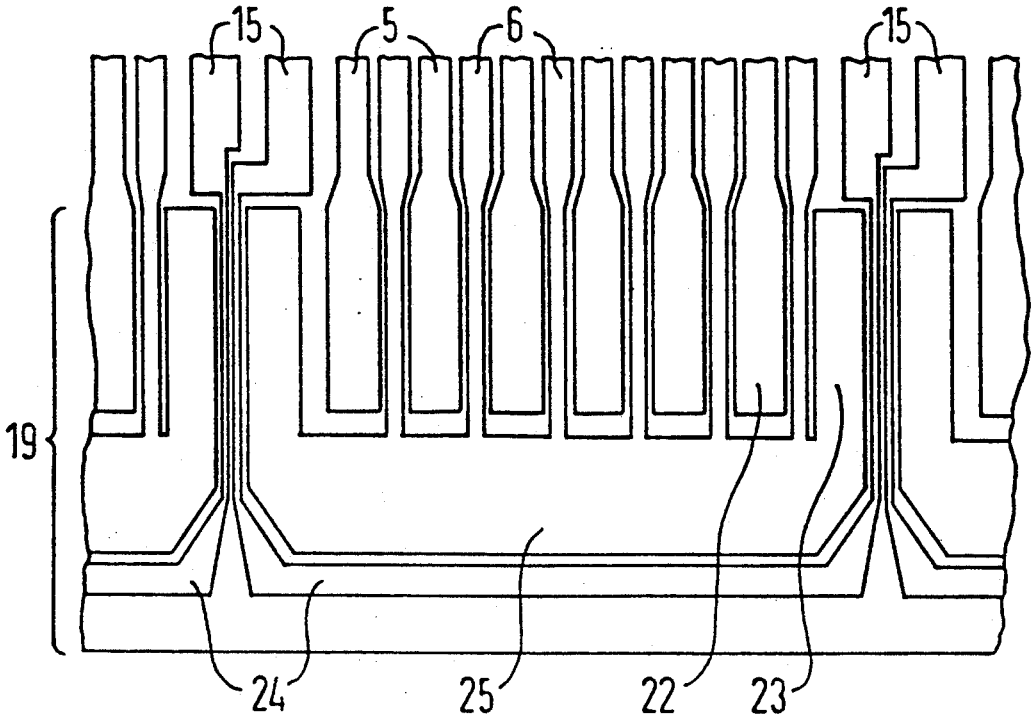
FIG. 4 is a view of a schematic diagram illustrating a group of conductor paths in the connection area.

FIG. 4 illustrates an enlarged section of the connector terminal field 19 with conductor paths combined into a group. While the conductor paths 5, designated in the following as individual conductor paths, exhibit expanded faces at their free ends formed as contact flags 22, where in each case an individual conductor of a connector cable can be contacted by the contact flags 22, the conductor paths 6 of the thermal converters 4, combined to a group, lead jointly to a relatively large-faced ground-connected bridge 25. Contact flags 23, projecting also into the direction of the conductor paths 5, 6, are formed at the ground-connected bridge 25 at the two front faces of the ground-connected bridge 25, such that there results overall a geometrically uniform, comb-shaped structure of a contact strip in the connector terminal field 19. The feed current and the return current line of a part section of the thermal resistor 15 is led in the remaining slot of the contact flags 23 of two neighboring ground-connected bridges 25 and the feed current line and return current line are connected by way of a contact bridge 24. Six thermal converters 4 with a total of twelve conductor paths are coordinated to the group illustrated in FIG. 4, where however only seven connectors are required for the contacting of this group, represented by six individual lines and by a ground-connected line. The controlled actuation of the individual thermal converters 4 can thereby be performed via a passive network, for example, via a per se known diode decoder matrix.

A material with a high temperature dependence of the electrical resistance value is employed as a material for this heating resistor 15 according to the invention. For example, aluminum with a temperature coefficient of $\alpha^{+}_{AL}=+4000$ ppm/K is deemed suitable for this purpose. By evaluation of this temperature coefficient of the electrical resistance of the heating resistor 15, this heating resistor 15 is employed as a heat source for the ink-jet liquid and simultaneously as a temperature sensor.

For this purpose, a resistor arrangement is employed forming a bridge circuit according to FIG. 5 for heating and for temperature measurement, where the temperature-sensitive resistors and the heating resistors are disposed on the thin-film substrate. The bridge resistors, forming temperature measurement and/or heating resistors, are designated with $R_1$, $R_2$, $R_3$, and $R_4$ in FIG. 5 and have temperature coefficients $\alpha_1$ through $\alpha_4$, and are connected to form a measurement bridge. At least one of the bridge resistors $R_1$, $R_2$, $R_3$, and $R_4$ is employed for heating and at least one of the bridge resistors $R_1$, $R_2$, $R_3$, and $R_4$ is employed for temperature measurement in each case. The heating resistor, the temperature resistor or the measurement resistor can also be provided by one identical element. An arrangement is particularly advantageous where several or all components of critical tolerances of the resistance bridge are integrated into the first metallization plane of the write head. Production-caused variations in this case influence all device component parts in the same manner and direction, but they do not influence the resistance ratios of, for example, of several resistors of a resistance bridges. This relationship, however, holds only in each case within one resistance layer. This method is in particular applicable with a write head, where two resistor materials with markedly different temperature coefficients are available, such as, for example hafnium diboride $HfB_2$ with $\alpha^{-}HfB_2=-70$ ppm/K and aluminum with $\alpha^{+}_{AL}=+4000$ ppm/K.

In each case, the resistors $R_1$ and $R_2$ as well as $R_3$ and $R_4$ are connected in series and are fed from a joint voltage source, supplying in particular the measurement voltage $U_B$. If the electrical potential at the right bridge ($R_3$, $R_4$) center is designated with $\phi_1$ and if the electrical potential at the left bridge ($R_1$, $R_2$) center is designated with $\phi_2$, then the temperature-dependent electrical potential difference $\Delta\phi=\phi_1-\phi_2$ depending on T is obtained at the bridge diagonal between $R_1$, $R_2$ and $R_3$, $R_4$.

The temperature signal $\Delta\phi$ (T), upon employing of a bridge branch, is illustrated in FIG. 6*a*. It is presupposed in FIG. 6*a* that the bridge resistor $R_3$ is made of aluminum with $\alpha^{+}_{AL}=+4000$ ppm/K and that the bridge resistors $R_1=R_2=R_4$ are made of hafnium diboride with $\alpha^{-}_{HfB2}=-70$ ppm/K. The heating resistor $R_3$ is thus passed through by the total heating current. A linearly dropping characterizing curve is obtained in this case for the potential $\phi_1$ depending on T proportional to the temperature, which linearly dropping characterizing curve intersects the characterizing curve for $\phi_2$ depending on T=constant at a point $T_C$, designated as crossover temperature point.

Employing the two bridge branches for temperature measurement, the temperature signal value $\Delta\phi$ depending on T is doubled, as illustrated in FIG. 6*b*. In this case, the measurement bridge is also passed by the total heating current, where the resistors $R_2$ and $R_3$ having the temperature coefficients $\alpha_2=\alpha_3$ symbolize the heating resistors.

For example, the temperature coefficients for the resistors can be: $R_2$, $R_3$ with $\alpha^{+}_{AL}=+4000$ ppm/K, $R_1$, $R_4$ with $\alpha^{-}_{HfB2}=-70$ ppm/K, wherein $\alpha_2=\alpha_3$, $\alpha_2>\alpha_1$ and $\alpha_1=\alpha_4$.

FIG. 7 illustrates a further embodiment for connecting and structuring the measurement bridge and/or heating bridge. In this case, the measurement voltage $U_B$ is applied to the bridge resistors $R_1$ and $R_3$ via a protection damping diode D. Back-acting-free and independent heating or measuring, respectively, is assured by the protection damping diode D. The heating current $I_H$ is fed in separately at the left bridge branch $R_1$, $R_2$ by a voltage $U_H$. Analog to the recited measurement bridges, the temperature signal $\Delta\phi$ depending on T can be picked up at the bridge diagonal between ($R_1$, $R_2$) and ($R_3$, $R_4$). According to this arrangement, initially the temperature is periodically measured and subsequently, depending on the measurement result, a current segment is fed through the heating resistor $R_2$ to ground. The bridge is passed by a measurement current $I_M$, which measurement current is small relative to the heating current $I_H$, for providing a temperature measurement. It is thereby assured that the measurement current $I_M$ effects only an unsubstantial heating of the temperature sensor.

Furthermore, the temperature signal of one or of the two bridge branches can be processed and evaluated.

Example for the employment of one bridge branch:
$R_1$, $R_3$, $R_4$=bridge resistors, for example $\alpha_1=\alpha_3=\alpha_4$ ($R_1$, $R_3$, $R_4$ with $\alpha^-_{HfB2}=-70$ ppm/K
$R_2$=heating resistor, for example, $\alpha_2$ ($R_2$ with $\alpha^+_{AL}=+4000$ ppm/K.

Example for the employment of the two bridge branches:
$R_1$, $R_4$=bridge resistors, for example $\alpha_1=\alpha_4$ ($R_1$, $R_4$ with $\alpha^-_{HfB2}=-70$ ppm/K
$R_2$, $R_3$=heating resistors, for example $\alpha_2=\alpha_3$ ($R_2$, $R_3$ with $\alpha_{AL}=+4000$ ppm/K).

In addition, there exists of course the possibility to employ either a separate thin-film temperature sensor, realized in the first metallization plane, or a separate discrete temperature sensor for the temperature measurement.

According to the employed temperature sensor and/or heater resistor configurations according to FIGS. 5 through 7, several types of automatic heating controllers can be employed for heating of the ink. It is assumed in the following exemplified embodiments of the automatic control circuits that the heating resistor is integrated into the measurement bridge.

FIG. 8 shows a circuit diagram of an analog comparator with a floating measurement bridge. While the reference characters $R_1$, $R_3$, $R_4$ designate the bridge resistors, the resistor $R_2$ represents the temperature-dependent heating resistor with positive temperature coefficient (PTC) for the temperature dependence of the resistance.

Starting from a measurement bridge, as illustrated in FIG. 5. a comparator K is employed in the diagonal branch for the evaluation of the temperature signal $\Delta\phi(T)$, where the output of the comparator K is connected to the base of a switching transistor ST via a resistor, not designated in detail. In addition, a resistor $R_B$ is connected to said base with a first terminal of the switching transistor ST for generating a base bias voltage and with a second terminal to voltage $U_B$. The measurement voltage $U_B$ is applied via the collector emitter terminals of the switching transistor ST and via a protection damping diode D, polarized in a passage direction to the bridge resistors $R_1$ and $R_3$. The bridge diode D is connected at a first end to the collector of the switching transistor ST and with the second end to bridge resistors $R_1$, $R_3$. A resistor $R_m$ between the emitter of the switching transistor ST and the cathode of the protection damping diode D serves for assuring a defined bridge potential, i.e. a small bridge current is always flowing, for example, even when the ambient temperature is higher than the reference temperature employed in the automatic control circuit.

Figure 9:
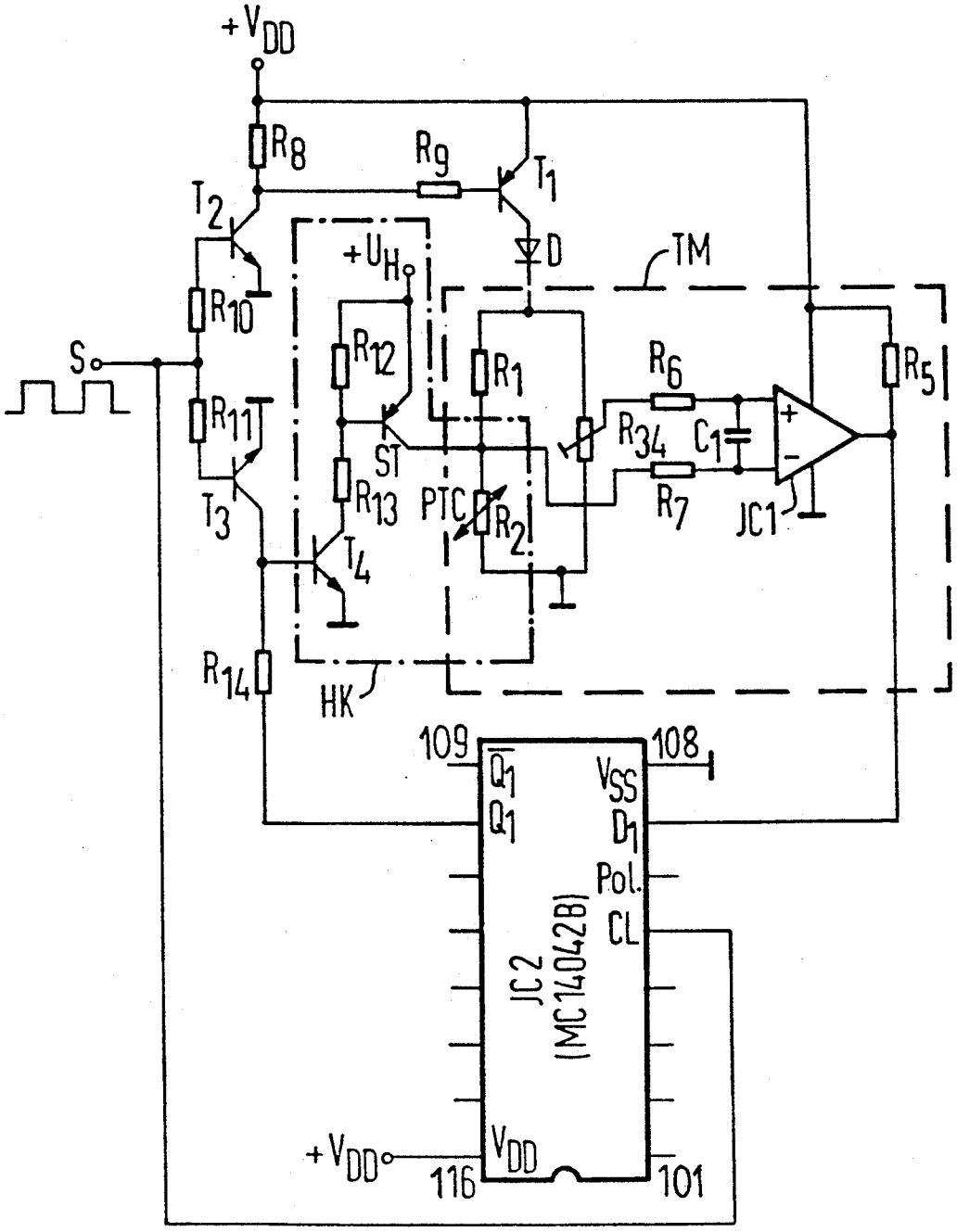
FIG. 9 is a view of a schematic circuit diagram of a clock-cycled automatic controller for providing heating current control.
Figure 10:
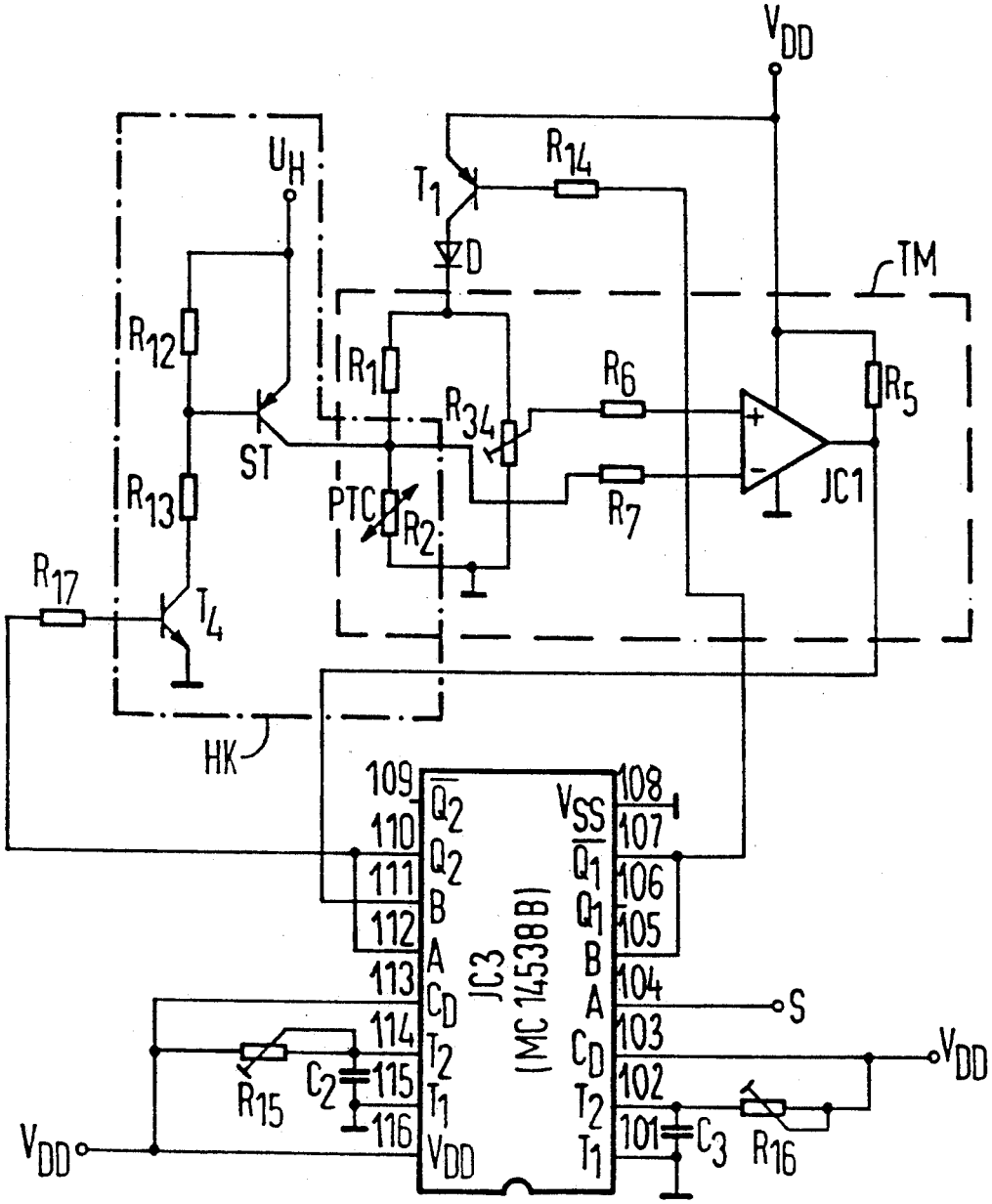
FIG. 10 is a view of a second embodiment illustrating a schematic circuit diagram of a clock-cycled automatic controller for heating purposes.

Two examples for clock-cycled automatic heater controllers are illustrated in FIGS. 9 and 10, where in each case only the heating resistor $R_2$ is fed with and passed by current. It is common to the two circuits illustrated in FIGS. 9 and 10 that they are operated with an external system clock cycle S and that they exhibit the same measurement bridge arrangement, as was described in connection with FIG. 7. Only the bridge resistors $R_3$ and $R_4$ are in this case substituted by a single resistor $R_{34}$ with a tap for the purpose of a balancing of the bridge.

The supply voltage for the measurement bridge and for the logical device components, comparator IC1, memory storage member IC2, is designated with the reference characters $V_{DD}$ according to FIG. 9. The positive pole of the heating voltage $U_H$ is connected via the emitter collector circuit of a switching transistor ST with the left bridge center. The temperature signal $\Delta\phi(T)$, picked up at the bridge diagonal, is led via two resistors $R_6$, $R_7$ to the input terminals of a comparator IC1, which input terminals in turn are connected to a capacitor C. The supply voltage $V_{DD}$ is applied both via the series connection of the emitter terminal and the terminal collector of a first transistor $T_1$ and of a protection damping diode D at the bridge resistors $R_1$ and $R_{34}$, as well as via an eigth resistor $R_8$ to the collector terminal of a second transistor $T_2$. A ninth resistor $R_9$ is connected between the collector of the second transistor $T_2$ and the base of the first switching transistor $T_1$. A clock-cycle signal is applied at the control input S, where the clock-cycle signal is lead via a tenth resistor $R_{10}$ to the base of the second transistor $T_2$ and via an eleventh resistor $R_{11}$ to the base of a third transistor $T_3$. The emitters of the second transistor $T_2$, and of the third transistor $T_3$ are connected to a ground potential of zero volt. In addition, this clock-cycle signal S controls a memory storage member IC2 via an input CL (FIG. 2). The output of the comparator IC1 is connected, on the one hand, with a data input $D_1$ of this memory storage member IC2 and, on the other hand, via a fifth resistor $R_5$ with the supply voltage $+V_{DD}$ (FIG. 9). A data output Q1 is connected via a fourteenth resistor $R_{14}$ to the base of the third transistor $T_3$ and to the collector of a fourth transistor $T_4$. While the emitter of the fourth transistor $T_4$ is connected to ground, the collector of the fourth transistor $T_4$ is connected via a voltage divider, including the first voltage divider resistor $R_{12}$ and the second voltage divider resistor $R_{13}$, to the base of the switching transistor ST or the supply voltage $+U_H$, respectively. A first end of the first voltage divider resistor $R_{12}$ and a first end of the second voltage divider resistor $R_{13}$ are connected to each other and to the base of the switching transistor ST. A second end of the first voltage divider transistor is connected to the supply voltage $U_H$.

Those parts, which form the heating circuit HK, are illustrated with a dash-dotted line, and those parts, which form the temperature measurement circuit TM, are surrounded with a dashed line for easier recognition and understanding of the automatic control circuit. It can be gathered once more from the overlapping of these two surrounding lines that the resistor $R_2$ serves as both a heating resistor as well as a temperature sensor.

While a clock-cycled storage flip flop, forming a latch, serves as a memory storage member IC2 in connection with the automatic temperature controller according to FIG. 9 and is operated with a defined clock-cycle ratio of the system clock-cycle S, the automatic temperature controller according to FIG. 10 employs the system clock-cycle S only for triggering. A dual mono-flop circuit is employed as a memory storage member IC3 for the embodiment shown in FIG. 10. Since in both circuits, the heating circuits HK and the temperature measurement circuit TM are substantially identical for the embodiments of FIG. 9 and FIG. 10, only those switching connections are described in connection with FIG. 10 which result from the use of the differing memory storage members.

Thus, the output of the comparator IC1 is connected to the terminal 111 of the memory storage member IC3 and the base of the transistor $T_1$ is connected to the terminals 105 and 107 of the memory storage member IC3 via a fourteenth resistor $R_{14}$. In addition, a connection between the base of the fourth transistor $T_4$ exists to the terminals 110 and 112 of the memory storage member IC3 via a seventeenth resistor $R_{17}$. The system clock-cycle S is connected to the terminal 104 of the memory storage member IC3. A second capacitor $C_2$ is switched and connected between the terminals 114 and 115 of the memory storage member IC3, and a third capacitor $C_3$ is switched and connected between the terminals 102 and 103. The supply voltage $V_{DD}$ is lead, on the one hand, immediately to the terminals 103, 112, and 116 of the memory storage member IC3 and, on the other hand, to the terminals 114 and 102 via adjustable resistors $R_{15}$, $R_{16}$. In addition, the terminals 101, 108, and 115 of the memory storage member IC3 are connected to ground potential. A small measurement current $I_M$ is applied to the measurement bridge during a half cycle $t_1$ of the system clock-cycle S, where the small measurement current $I_M$ results only in an unimportant and/or negligible heating of the heating resistor. The temperature signal $\Delta\phi(T)$ depending on the temperature T, which can be picked up at the bridge diagonal and which is processed and evaluated by the comparator IC1, generated a logic comparator output signal which can be either low or high, and which output signal is entered and written into memory storage member IC3. During the next half cycle $t_2$ of the system clock-cycle S, pointedly only the heating resistor $R_2$ is fed or not fed with current, respectively, corresponding to the memory storage entry (high) or (low). This process is periodically repeated as controlled by the system clock-cycle S.

The principle dependence and the time development of several automatic control values is illustrated in FIG. 11 for further clarification and elaboration on the functioning of the automatic control circuit of FIG. 9.

The system clock-cycle S is illustrated with a scanning ratio $\gamma = t_1/t_1 + t_2$ in line a) of FIG. 11. The ordinate of line a) indicates the logical level 0 or 1 of the signal. The temperature course of the heating resistor $R_2$ is illustrated in line b) of FIG. 11 where additionally the set point temperature $t_{set\ point}$ is entered by way of a dashed line. The ordinate represents the temperature $TR_2$ at resistor $R_2$. The logical states of the memory storage output $Q_1$ of the memory storage member IC2 are illustrated and clarified in line c) of FIG. 11. Line d) of FIG. 11 finally illustrates and represents the courses of the heating current $I_H$ and of the measurement current $I_M$. The ordinate of line d) of FIG. 11 represents whether a certain current is on or off. A higher current level of the heating current corresponds to a larger ordinate value of line d) of FIG. 11.

Starting at the point in time $t_o$, with the rising slope of the system clock-cycle S, (FIG. 11,*a*)) there is flowing a measurement current $I_M$ (FIG. 11,*d*)) through the measurement bridge during the time period $t_1$; the measured temperature $T_{R2}$ of the heating resistor $R_2$ (FIG. 11,*b*)) is lower during this time period according to line b) as compared to the set-point temperature $t_{set\ point}$. Consequently, the heating resistor $R_2$ is fed with current during the following time period $t_2$. The temperature $T_{R2}$ rises. A measurement of the temperature begins with the next following rising slope of the system clock-cycle S. Since this measure temperature is disposed above the set-point temperature $T_{set\ point}$, about at the end of time interval $t_2$ of FIG. 11, the heating resistor $R_2$ is not fed with current during the next following half period $t_2$ of the system clock-cycle S. Since the temperature $T_{R2}$ is still higher during a following measurement cycle, designated on the time axis with $t_i$, as compared to the temperature $T_{set\ point}$, the heating resistor $R_2$ is consequently not yet fed with current during the then following half period of the system clock-cycle S.

Figure 12:
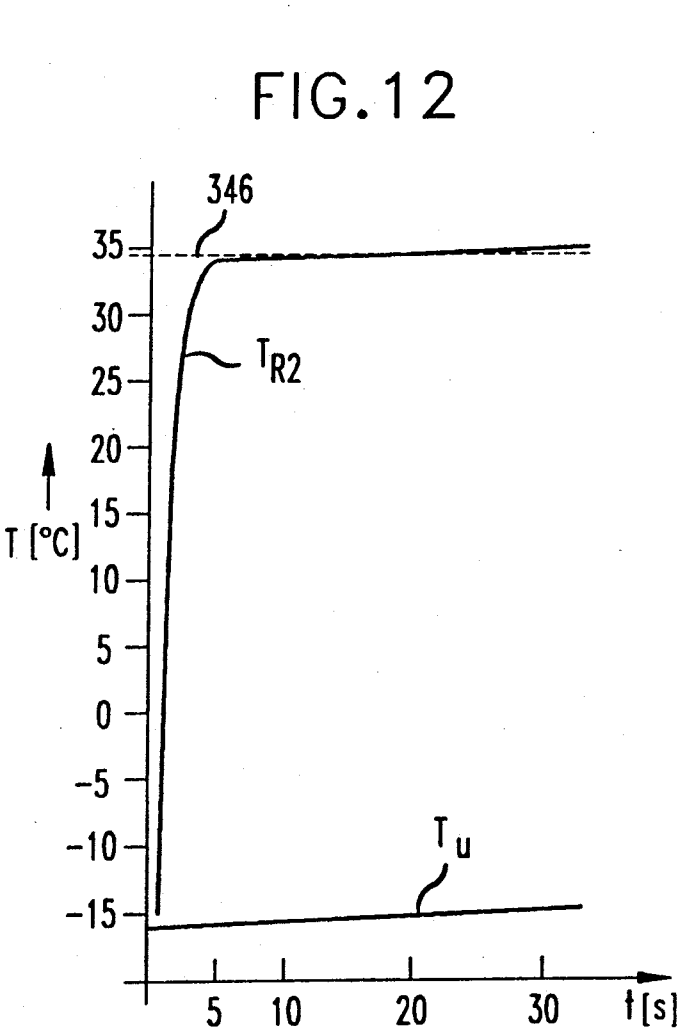
FIG. 12 is a view of a schematic functional diagram illustrating the course of the temperature value at the heating resistor depending on time.
Figure 11A:
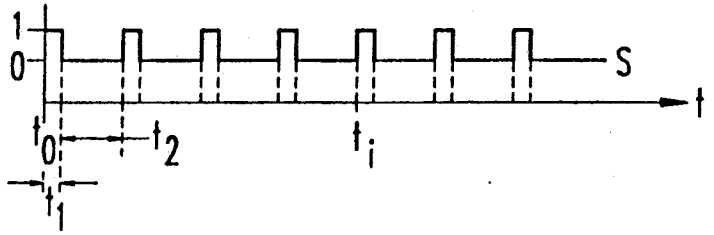
FIGS. 11*a–d* are views of a schematic functional diagram illustrating the pulse height values versus time of a clock-cycled automatic controller according to FIG. 9.
Figure 11B:
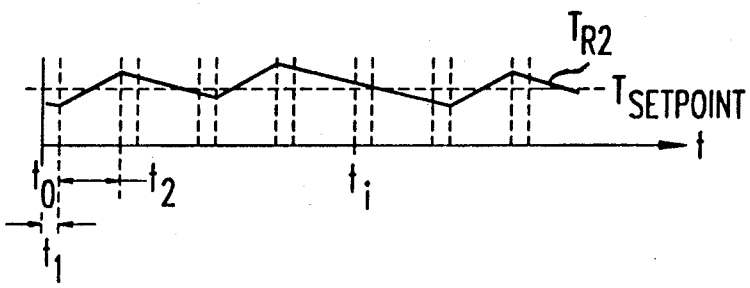
Figure 11C:
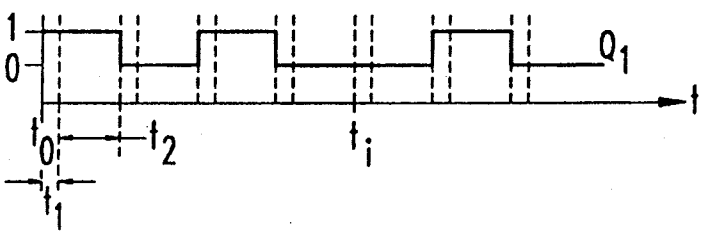
Figure 11D:
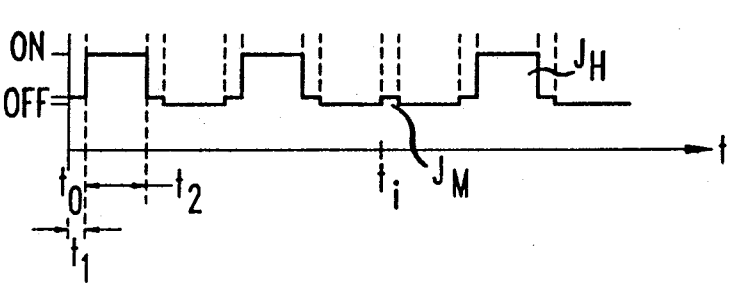

The temperature initial oscillation behavior and the temperature value stability of the heating resistor $R_2$ of such an automatic control circuit is illustrated in FIG. 12. In addition to the course depending on time of the heating temperature $T_{R2}$, there is illustrated additionally the ambient temperature $T_u$.

Upon employment of a thin-film foil heating element, serving as a heating resistor $R_2$ and as a temperature sensor, having a temperature coefficient of $\alpha + = +3200$ ppm/K, the following values or device types, respectively, of the individual device components have proven to be particularly advantageous:

$U_H \leqq 40$ V, $V_{DD} \leqq 18$ V, IC1=LM 393, IC2=MC 14042 B,
IC3=MC 14538 B, $R_1 = 390\ \Omega$, $R_{34} = 25$ k $\Omega$,
R6=R7=56 k $\Omega$, $R_5 = 680$ k $\Omega$, $R_9, R_{13} = 6.8$ k $\Omega$,
$R_8$, $R_{10}$, $R_{14}$, $R_{17} = 10$ k $\Omega$, $R_{11} = 4.7$ k $\Omega$, $R_{12} = 1$ k $\Omega$,
$C \leqq 1$ nF, C2=4 $\mu$F, C3=0.1 $\mu$F, $R_{15}$, $R_{16} = 100$ k $\Omega$,
$T_2$, $T_3$, $T_4$=BCY 59, $T_1$=BC 307, ST=BC 327.

It will be understood that each of the elements described above, or two or more together, may also find a useful application in other types of heating arrangements differing from the types described above.

While the invention has been illustrated and described as embodied in the context of an arrangement for heating the ink in the write heat of an ink-jet printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A device for heating of an ink in a write head constructed based on layer technology for an ink-jet printer, comprising the following features:

(a) a plurality of electrothermal converter elements (4), disposed in ink channels, are controlled by individual current feed lines provided as conductor paths (5, 6), (b) the electrothermal converter elements (4) and the conductor paths (5, 6) are generated in a single metallization plane on a substrate (2), (c) a number of conductor paths (5, 6) are combined in groups, wherein said groups in turn are placed at a distance relative to each other defined by intermediate spaces, (d) part sections of a large-face heating resistor (15) are disposed in these intermediate spaces in a first metallization plane, wherein the part sections of the large-face heating resistor are electrically connected amongst each other, (e) the part sections of the heating resistor (15) and the conductor paths (5, 6) lead to an edge region of the write head and are contacted at the edge region, and (f) the electrothermal converter elements (4), the conductor paths (5, 6) and the heating resistor (15) are jointly covered with an isolator layer (7), (g) the heating resistor (15) serves as a heat source and simultaneously as a temperature sensor.

2. The device according to claim 1, wherein the part sections of the large face heating resistor (15) are structured in a meander shape.

3. The device according to claim 1, wherein the heating resistor (15) is made of a material with a high temperature dependence of an electrical resistance.

4. The device according to claim 1, wherein the heating resistor (15) is disposed and connected in a branch of a measurement bridge of a bridge circuit for heating and for temperature measurement, and wherein a temperature signal $\Delta\phi(T)$ is picked up at a diagonal of the bridge and wherein remaining bridge resistors are integrated into the first metallization plane.

5. The device according to claim 4, wherein the measurement bridge having branches is passed through by a total heating current ($I_H$) and wherein the temperature signal of at least one branch of the bridge is processed and evaluated.

6. The device according to claim 4, wherein the measurement bridge is passed through by a measurement current ($I_M$) which has a smaller value than a value of a total heating current ($I_H$), and wherein only the heating resistor (15) is fed with current for heating.

7. The device according to claim 4, wherein an analog comparator (K) serves for evaluation of the temperature signal ($\Delta\phi(T)$) generated by the measurement bridge where an output of a comparator (K) controls a voltage supply ($U_B$) for the measurement bridge by an electronic switch (ST).

8. The device according to claim 4, wherein two-point automatic control circuits with an external system clock-cycle (S) are employed for an automatic control of a temperature, wherein the two-point automatic control circuits apply during a half period of the system clock-cycle (S) a measurement current ($I_M$) to the measurement bridge, wherein the temperature signal ($\Delta\Phi(T)$), picked up at the bridge diagonal, is fed to a comparator (IC1) for evaluation, wherein an output signal of the comparator (IC1) is entered and registered into a memory storage member (IC2, IC3), and wherein, during a next half cycle of the system clock-cycle (S), the heating resistor (15) is either fed with current or not fed with current depending on an entry into a memory storage member (IC2, IC3).

9. The device according to claim 8, wherein the memory storage member (IC2, IC3) is provided as a bistable multivibrator.

10. The device according to claim 1, wherein at least one of bridge resistors serves for heating and wherein at least one of the bridge resistors serves for temperature measurement.

11. The device according to claim 1, wherein a separate thin-film temperature sensor is employed for measuring a heating temperature of the heating resistor (15), and wherein said thin-film temperature sensor is integrated into the first metallization plane.

12. The device according to claim 1, wherein a separate, discrete temperature sensor is employed for measuring a heating temperature of the heating resistor (15).

13. A device for heating of an ink in a write head for an ink-jet printer comprising a print head substrate;

a plurality of ink channels for delivering ink droplets to a print substrate;

a plurality of electrothermal convertor elements corresponding to the plurality of ink channels and disposed for delivering heat to ink flowing in said ink channels;

a plurality of individual current feed lines corresponding to the plurality of electrothermal converter elements and furnished as electrical conductor paths for delivering electrical energy to the electrothermal converter elements and wherein the electrothermal converter elements and the conductor paths are generated in a single metallized layer on the print head substrate, wherein the plurality of individual current feed lines is subdivided into a number of groups, wherein said groups in turn are placed at a distance relative to each other defined by intermediate spaces between neighboring groups in the metallized layer;

a large-face heating resistor having part sections disposed in said intermediate spaces in the metallized layer, wherein the part sections of the large-face heating resistor are electrically connected to each other and wherein the part sections of the heating resistor and the conductor paths are led to an edge region of the print head substrate and wherein the part sections of the heating resistor and the conductor paths are contacted at the edge region;

an insulator layer covering jointly the electrothermal converter elements, the conductor paths and the large-face heating resistor; and the large face heating resistor serves as a heat source and simultaneously as a temperature sensor.

14. The device according to claim 13, wherein the part sections of the large face heating resistor are structured in a meander shape.

15. The device according to claim 13, wherein the large face heating resistor is made of a material exhibiting a high temperature dependence of an electrical resistance.

16. The device according to claim 13 further comprising bridge circuit resistors forming together with the large face heating resistor a measurement bridge of a bridge circuit for heating and for temperature measurement, wherein the large face heating resistor is disposed and connected in a branch of the measurement bridge of a bridge circuit and wherein a temperature signal $\Delta\phi(T)$ is picked up at a diagonal of the measurement bridge and wherein the bridge circuit resistors are integrated into the metallized layer.

17. The device according to claim 16, wherein at least one of the bridge circuit resistors serves for heating and wherein at least one of the bridge resistors serves for temperature measurement.

18. The device according to claim 16, wherein the measurement bridge has branches and accommodates a total heating current and wherein a temperature signal of at least one of the branches of the measurement bridge is processed and evaluated.

19. The device according to claim 16, wherein the measurement bridge is passed through by a measurement current, wherein the measurement current has a smaller value than a value of a total heating current, and wherein only the large face heating resistor is fed with current for heating ink.

20. The device according to claim 16 further comprising an electronic switch connected to the measurement bridge;

a voltage supply connected to the electronic switch and thereby to the measurement bridge;

an analog comparator connected to the measurement bridge for evaluating the temperature signal ($\phi(T)$) generated by the measurement bridge, wherein an output of the analog comparator controls the voltage supply for the measurement bridge through the an electronic switch.

21. The device according to claim 16 further comprising a comparator connected to the bridge circuit;

a memory storage member connected to the comparator;

a two-point automatic control circuit for receiving an external system clock-cycle and for furnishing an automatic control of a temperature, wherein the two-point automatic control circuit applies a measurement current to the measurement bridge during a half period of the external system clock-cycle, wherein the temperature signal ($\Delta\Phi(T)$), picked up at the bridge diagonal is fed to the comparator for evaluation, wherein an output signal of the comparator is entered and registered into the memory storage member, and wherein the large face heating resistor is either fed with current or not fed with current depending on an entry into the memory storage member during a next half cycle of the external system clock-cycle.

22. The device according to claim 21, wherein the memory storage member is provided as a bistable multivibrator.

23. The device according to claim 13 further comprising a separate thin-film temperature sensor connected independent of the heating resistor and employed for measuring a heating temperature of the heating resistor, and wherein said separate thin-film temperature sensor is integrated into the metallized layer.

24. The device according to claim 13 further comprising a separate, discrete temperature sensor is employed for measuring a heating temperature of the heating resistor.

25. The device according to claim 13 wherein the heating resistor is integrated into the metallized layer, wherein the heating resistor is generated directly from one of two electrically conductive thin films, deposited on a base oxide, and is disposed in empty spaces present on the thin-film substrate accommodating the thermal converters and the conductor paths.

26. The device according to claim 25, wherein the part sections of the large face heating resistor are structured in a meander shape.

27. The device according to claim 13 wherein the plurality of thermal converters and the corresponding feed lines are disposed symmetrically relative to an axis on the print head substrate and wherein electrical feed lines form a plane and lead as conductor paths from the thermal converters disposed in an edge-proximity region of the print head substrate to a terminal connector field disposed on as side of the print head substrate opposite to a side of a position of the electrothermal converters;

wherein the conductor paths are subdivided, starting from the electrothermal converters into conductor paths of narrow subdivision and in a region of the connector terminal field into conductor paths of wide subdivision; wherein a transition structure connects the conductor paths of narrow subdivision to the conductor paths of wide subdivision.

28. The device according to claim 27 wherein a conductor width in a transition structure is dimensioned according to the following rules based on the above-recited structural values of the two conductor-path regions of narrow and wide subdivisions to be connected, and based on two neighboring conductor paths L1, L2, namely conductor-path widths $d_a$, $d_b$ and slot widths $s_a$, $s_b$, as well as from a slot width $s_v$ in the transition structure:

$$d_v = -s_v/2 + \sqrt{s_v^2/4 + c} \text{ with}$$

$$c = d_b \cdot d_a \cdot (d_b + s_b - d_a - s_a)/(d_b - d_a),$$

wherein dv is the width of the conductor and c is an intermediate computing parameter.

29. The device according to claim 27 further comprising empty spaces formed between the conductor paths bundled into two neighboring groups, wherein widths of the empty spaces between the two neighboring groups correspond to the group distances, and wherein the empty spaces are employed for placement of the large face heating resistor forming a resistance heating meander in these empty spaces;

connector flags attached to ends of the current feed lines, wherein two current feed lines of the large face heating resistor run in an edge region of the print head substrate to a connector terminal field and end at the connector flags;

a connector bridge, wherein the thermal resistor is subdivided into several part sections according to the number of the empty spaces generated by a spreading of the conductor paths, and wherein the several part sections are connected in the connector terminal field with the contact bridge;

a series connection of the part sections, wherein an end of a part section is connected to a starting point of a next following part section, such that there results overall a series connection of the part sections and for subjecting the thermal resistor to a heating voltage and/or a heating current fed through the connector flags.

30. The device according to claim 29 wherein the current feed lines exhibit expanded faces at free ends thereof formed as contact flags;

wherein an individual conductor of a connector cable is contacted by the contact flags;

wherein the current feed lines of the thermal converters are combined to a group and are led jointly to a relatively large-faced ground-connected bridge;

wherein the contact flags are projecting also into a direction of the conductor paths and are formed at the relatively large-faced ground-connected bridge at the two front faces of the ground-connected bridge such that there results overall a geometrically uniform, comb-shaped structure of a contact strip in the connector terminal field;

wherein one of the plurality of feed current lines and one of the plurality of return current lines of one of the plurality of part sections of the heating resistor is led in a remaining slot of the contact flags of two neighboring ground-connected bridges; and wherein the feed current line and return current line are connected by way of a contact bridge; a passive network performing a controlled actuation of the individual thermal converters based on a passive network.

31. The device according to claim 29 wherein the heating resistor is formed of a material with a high temperature dependence of the electrical resistance value;

wherein the heating resistor forms a bridge circuit for heating and for temperature measurement, wherein the temperature-sensitive resistors and the heating resistors are disposed on the thin-film substrate;

wherein the bridge resistors are forming temperature measurement elements and/or heating resistors and have temperature coefficients $\alpha_1$ through $\alpha_4$, and are connected to form a measurement bridge;

wherein at least one of the bridge resistors is employed for heating;

wherein at least one of the bridge resistors is employed for temperature measurement;

wherein components of critical tolerances of the resistance bridge are integrated into the metallized layer of the write head;

wherein the heating resistors are connected in series and are fed from a joint voltage source.

32. The device according to claim 13 further comprising a protection damping diode applying a measurement voltage to bridge resistors;

an automatic heating controller connected to the heating resistors for heating of the ink and wherein the heating resistor is integrated into the measurement bridge and wherein the heating resistor is a positive temperature coefficient heating resistor.

33. The device according to claim 13 further comprising a voltage source;

a first bridge resistor;

a second bridge resistor;

a third bridge resistor;

a comparator forming a diagonal branch of a bridge circuit including the first bridge resistor, the second bridge resistor, the third bridge resistor and the comparator for an evaluation of a temperature signal and having an output;

a resistor connected to the output of the comparator;

a switching transistor having a base and collector emitter terminals including an emitter terminal and a collector terminal, wherein the output of the comparator is connected to the base of a switching transistor through the resistor;

a second resistor having a first terminal and a second terminal and connected to said base of the switching transistor with the first terminal for generating a base bias voltage and connected with the second terminal to the voltage source and wherein the voltage source is connected to the collector emitter terminals of the switching transistor;

a protection damping diode having a first end and having a second end with one of the ends representing a cathode and wherein the protection damping diode is polarized in a passage direction to the first bridge resistor and to the third bridge resistor and connected at a first end to a collector terminal of the switching transistor and with the second end to bridge resistors;

a third resistor disposed between the emitter terminal of the switching transistor and the cathode of the protection damping diode for assuring a defined bridge potential.

34. The device according to claim 33 further comprising an external system clock terminal for delivering a clock signal; a memory storage member having a data input connected to the output of the comparator and connected to the external system clock terminal;

a sixth resistor;

a seventh resistor;

a heating voltage source having a positive pole, wherein the positive pole of the heating voltage is connected via the emitter collector terminals circuit of the switching transistor to a left bridge center and wherein a temperature signal is picked up at the bridge diagonal and wherein the temperature signal is led through the sixth resistor and through the seventh resistor to input terminals of the comparator;

a first transistor;

a second transistor having a collector terminal and having a base terminal and having an emitter terminal;

an eighth resistor;

a capacitor connected to the input terminals of the comparator; a supply voltage source applied both via the series connection of the emitter terminal and the terminal collector of the first transistor and of the protection damping diode at the first bridge resistor and at the third bridge resistor and through the eighth resistor to the collector terminal of the second transistor;

a ninth resistor is connected to the collector terminal of the second transistor and the base of the first transistor;

a control input for application of a clock-cycle signal;

a tenth resistor connected to the base terminal of the second transistor, where the clock-cycle signal is lead through the tenth resistor to the base of the second transistor;

a third transistor having a base terminal and an emitter terminal and wherein the emitter of the third transistor is connected to the emitter of the second transistor;

an eleventh resistor, wherein the clock-cycle signal is led through the eleventh resistor to the base terminal of the third transistor;

a fifth resistor connected to the data input of the memory storage member and to the supply voltage source;

a fourteenth resistor;

a fourth transistor having a collector terminal and an emitter terminal for ground connection;

a data output connected through the fourteenth resistor to the base terminal of the third transistor and to the collector terminal of the fourth transistor;

a voltage divider including a first voltage divider resistor defined by a twelfth resistor having a first end and a second voltage divider resistor defined by a thirteenth resistor having a first end and connected to the collector terminal of the fourth transistor and to the base of the switching transistor, wherein the first end of the first voltage divider resistor and a first end of the second voltage divider resistor are connected to each other and to the base of the switching transistor and wherein a second end of the first voltage divider transistor is connected to the supply voltage source.

35. The device according to claim 34 wherein the memory storage member is furnished as a clock-cycled storage flip flop forming a latch.

36. The device according to claim 13, further comprising bridge circuit resistors forming together with the large face heating resistor a measurement bridge of a bridge circuit for heating and for temperature measurement, wherein the large face heating resistor is disposed and connected in a branch of the measurement bridge of a bridge circuit and wherein a temperature signal $\Delta\phi(T)$ is picked up at a diagonal of the measurement bridge and wherein the bridge circuit resistors are integrated into the metallized layer, wherein at least one of the bridge circuit resistors serves for heating and wherein at least one of the bridge resistors serves for temperature measurement, wherein the part sections of the large face heating resistor are structured in a meander shape, wherein the large face heating resistor is made of a material exhibiting a high temperature dependence of an electrical resistance and wherein the large face heating resistor serves as a heat source and simultaneously as a temperature sensor, wherein the measurement bridge has branches and accommodates a total heating current and wherein a temperature signal of at least one of the branches of the measurement bridge is processed and evaluated, wherein the measurement bridge is passed through by a measurement current, wherein the measurement current has a smaller value than a value of a total heating current, and wherein only the large face heating resistor is fed with current for heating ink;

an electronic switch connected to the measurement bridge;

a voltage supply connected to the electronic switch and thereby to the measurement bridge;

an analog comparator connected to the measurement bridge for evaluating the temperature signal ($\Delta\phi(T)$) generated by the measurement bridge, wherein an output of the analog comparator controls the voltage supply for the measurement bridge through the an electronic switch;

a comparator connected to the bridge circuit;

a memory storage member connected to the comparator;

a two-point automatic control circuit for receiving an external system clock-cycle and for furnishing an automatic control of a temperature, wherein the two-point automatic control circuit applies a measurement current to the measurement bridge during a half period of the external system clock-cycle, wherein the temperature signal ($\Delta\phi(T)$), picked up at the bridge diagonal is fed to the comparator for evaluation, wherein an output signal of the comparator is entered and registered into the memory storage member, and wherein the large face heating resistor is either fed with current or not fed with current depending on an entry into the memory storage member during a next half cycle of the external system clock-cycle.

* * * * *